US007191844B2

(12) United States Patent
Kenison et al.

(10) Patent No.: US 7,191,844 B2
(45) Date of Patent: Mar. 20, 2007

(54) INFLATE CONTROL SYSTEM FOR INFLATABLE STRADDLE STIMULATION TOOL

(75) Inventors: Michael H. Kenison, Missouri City, TX (US); William D. Eatwell, Pearland, TX (US); Joseph K. Flowers, Houston, TX (US); Gokturk Tunc, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 85 days.

(21) Appl. No.: 10/754,399

(22) Filed: Jan. 9, 2004

(65) Prior Publication Data

US 2005/0150661 A1 Jul. 14, 2005

(51) Int. Cl.
*E21B 33/124* (2006.01)
*E21B 34/14* (2006.01)

(52) U.S. Cl. ..... 166/387; 166/191; 166/187; 166/374; 166/147; 166/324; 166/334.4; 166/184; 166/151

(58) Field of Classification Search ..... 166/387, 166/191, 187, 374, 147, 319, 321, 324, 334.1, 166/334.4, 150–152, 184, 305.1; 377/331–334
See application file for complete search history.

(56) References Cited

U.S. PATENT DOCUMENTS 2,227,730 A * 1/1941 Lynes ..... 166/147
2,235,318 A * 3/1941 Halliburton ..... 166/147
2,643,723 A * 6/1953 Lynes ..... 166/152
2,796,938 A * 6/1957 Lynes et al. ..... 166/147
2,824,612 A * 2/1958 Lynes ..... 166/147
4,913,231 A * 4/1990 Muller et al. ..... 166/250.17
5,718,288 A * 2/1998 Bertet et al. ..... 166/287

FOREIGN PATENT DOCUMENTS

GB 2 384 015 7/2003

* cited by examiner

*Primary Examiner*—Kenneth Thompson
(74) *Attorney, Agent, or Firm*—Tim Curington; Robin Nava; Dale Gaudier

(57) ABSTRACT

A method and apparatus for controlling inflation and deflation of spaced inflatable packer elements of a straddle stimulation tool within a well casing of a well. A straddle stimulation tool is positioned by tubing at a desired location within the well casing. Fluid is pumped through the tubing and tool at a rate inflating the spaced inflatable packer elements within the well casing and establishing an annulus interval. The inflation control retains pressure within the inflated packer elements and permits the flow of stimulation fluid into the annulus interval for stimulation of the formation. After completion of well stimulation, the packer element pressure control is moved to a packer equalizing position by tension applied via the tubing to equalize packer pressure with casing annulus pressure, deflating the packer elements and permitting conveyance of the straddle stimulation tool within the well casing by the tubing string.

9 Claims, 5 Drawing Sheets

INFLATE CONTROL SYSTEM FOR INFLATABLE STRADDLE STIMULATION TOOL

BACKGROUND OF THE INVENTION

1. Field of the Invention

The present invention relates generally to straddle packer tools for straddling and isolating a casing interval within which well treatment operations, such as production formation fracturing, are typically conducted. More particularly, the present invention concerns a straddle packer tool having spaced inflate packers for sealing within a well casing to define a sealed casing interval and having an inflate control system that is controllable from the surface for inflation of the packer elements, storing and releasing stored packer inflation pressure and for controlling differing modes of tool operation. The present invention also concerns a method, controllable from the surface, for flow responsive inflation of packer elements, storing inflation pressure within the packer elements, and selective mechanically actuated deflation of the packer elements to enable use of a straddle tool for interval treatment and to facilitate movement of the straddle packer tool to different subsurface locations and to facilitate retrieval of the tool.

2. Description of the Prior Art

The term "straddle stimulation tools", as used herein, is intended to mean any well servicing tool having spaced packer elements and which is used within a well to isolate a particular subsurface zone or interval, typically having a casing with perforations, the tool having a fluid supply for various well treatment operations, such as acid injection, formation fracturing, with proppant injection into formation fractures that develop during fracturing, and any other well service operation where a fluid is injected into a casing interval for any character of treatment of the formation surrounding the casing interval. The term "element" as used herein is intended to mean a packer element, particularly an inflatable packer element, which is mounted on a well stimulation tool. Two or more packer elements are supported in spaced relation by a well stimulation tool and when sealed within the well casing, define a casing interval into which well stimulation fluid is pumped for treatment of a formation zone that is communicated with the well casing by perforations in the casing.

The production of an oil or gas well can often be improved by injecting treating or stimulation fluids directly into the formation(s) through perforations in the casing. Moreover, the benefits are often greater if, for a given well, multiple zones are isolated and treated separately. In order to isolate a particular zone, it must be effectively sealed off from the rest of the well. This can be done using elastomeric packer elements that seal with the well casing and block the annulus between the well casing and the downhole tool; the packer elements, when positioned in straddling position, are located above and below the casing perforations and thus straddle a given zone within the casing. Treatment fluid is then injected through a conveyance and fluid supply mechanism, such as coiled tubing, and the fluid is forced out of the tool, in between the packer elements, and into the formation via the casing perforations.

In many wells, the stimulation tool must pass through small diameter production tubing before reaching the larger diameter casing. This requires the use of inflatable sealing elements that, when deflated and thus contracted to a small dimension, will pass through production tubing and other restrictions and, after inflation, will have enough volume and mechanical integrity to fill and seal the large annulus that typically exists between the tool and the casing wall. Furthermore, the tool must be capable of directing fluid that is pumped from surface through different paths at the various stages of the tool operation. For example, at certain times the fluid must be directed into the packer elements for packer inflation, above the upper sealing element, and in between the elements for formation treatment.

Inflatable straddle stimulation tools in the market today require varying degrees of coiled tubing manipulation in order to accomplish packer deflation and to shift the tool from one position to another within the well casing and to direct the fluid pumped from surface. The inherent difficulties in accomplishing these features, particularly in deep or deviated wells, result in straddle tools that are often unreliable and difficult to operate.

SUMMARY OF THE INVENTION

It is a principal feature of the present invention to provide a novel inflatable stimulation or treatment tool for wells, with the tool having inflatable straddle packers for sealing at spaced locations within a well casing and thus defining an isolated casing interval for which stimulation or treatment is desired.

It is another feature of the present invention to provide a novel inflatable well stimulation or treatment tool having spaced inflatable packer elements and further having a control system for inflating the packer elements, storing and sealing the pressure in the packer elements and directing the pumped fluid between the inflatable packer elements and then deflating the packer elements to permit movement of the tool to another location within the well or to permit retrieval of the tool from the well.

It is also a feature of the present invention to provide a novel inflatable stimulation or treatment tool for wells, which establishes a flow path through an injection port and achieves packer inflation without any requirement for tool movement and achieves packer deflation by simple application of a pulling force of predetermined magnitude.

It is another feature of the present invention to provide a novel inflatable well stimulation or treatment tool that can be simply and efficiently operated from the surface to achieve the various operational modes of the tool and to switch between the operational modes.

Briefly, the various objects and features of the present invention are realized by a stimulation or treatment tool that is run into and retrieved from wells by a tubing string composed of coiled tubing or flexible jointed tubing, thus permitting the tool to be run into, moved within or retrieved from highly deviated or horizontal well sections as well as vertical well sections. Especially when coiled tubing is being employed for tool conveyance and treatment fluid delivery, it should be borne in mind that significant tensile force may be applied to the coiled tubing, such as for retrieval of the coiled tubing and straddle tool, but only limited compression or pushing force may be applied to the coiled tubing. When excessive pushing force is applied, the coiled tubing will readily become buckled and damaged. When the packer elements of a straddle tool are deflated and thus contracted, coiled tubing can easily be pushed at the surface without significant risk of buckling to enable downward movement of the straddle tool for tool positioning, even under circumstances where the wellbore has highly deviated or horizontal sections.

When used as part of an inflatable straddle stimulation tool, a well stimulation tool embodying the principles of the present invention will allow the operator at surface to inflate the packer elements, store and seal the pressure within the inflated packer elements to maintain effective sealing within the well casing, direct the flow path of the fluid supply through the inject port between the packer elements, and then deflate the packer elements when stimulation tool movement or retrieval is desired. The only coiled tubing manipulation that is typically necessary will be required at the end of the well or formation stimulation procedure to deflate and thus unseal the packer elements. The apparatus will also automatically reset to its starting position after deflation so that the tool can be moved downwardly or upwardly to additional zones during the same trip in the well.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic longitudinal sectional view of a straddle packer tool in assembly with an inflation control system in accordance with the principles of the present invention;

FIG. 2 is a block diagram operational schematic illustration of the inflation control system of FIG. 1 depicting the operational sequence thereof within a well;

FIG. 3A is a schematic longitudinal sectional view similar to that of FIG. 1 and showing the straddle packer tool and inflation control system with a well casing and illustrating operation at a low flow rate;

FIG. 3B is a schematic longitudinal sectional view similar to that of FIG. 3A and illustrating operation at a high flow rate;

FIG. 4A is a schematic longitudinal sectional view similar to that of FIG. 3A and illustrating fluid pumping through the tool and inflation control assembly in the inject mode for injecting stimulation or treatment fluid into the formation surrounding casing perforations;

FIG. 4B is a schematic longitudinal sectional view similar to that of FIG. 4A and illustrating the condition where the straddle packer tool and inflation control assembly are in the inject mode, but fluid injection is not occurring;

Figure 3A:
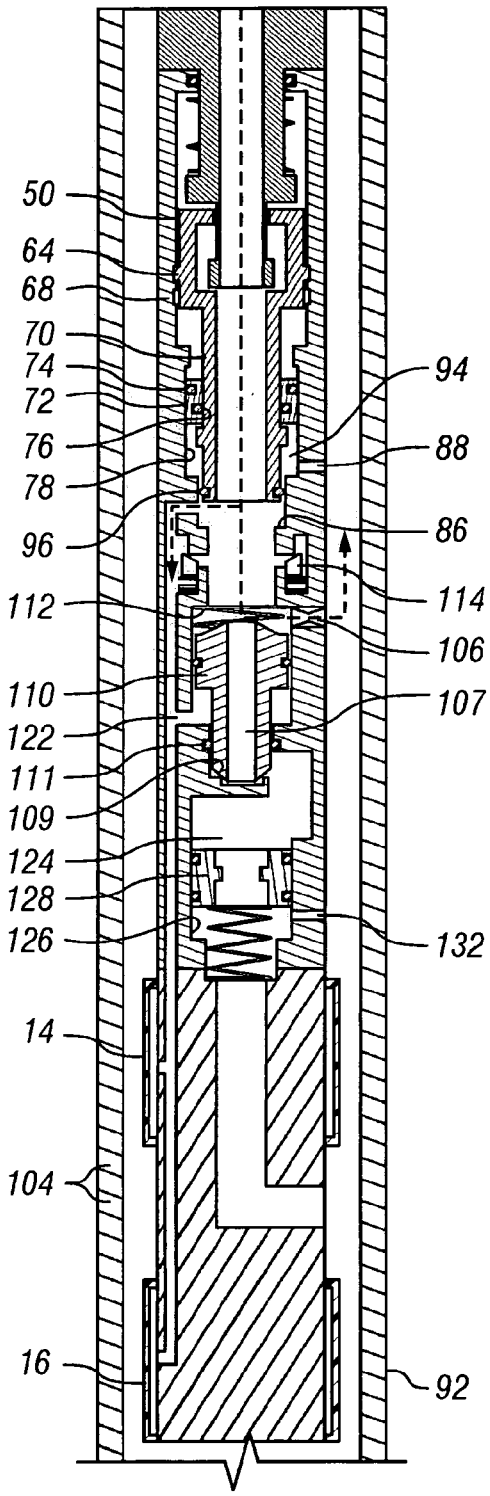
Figure 3B:
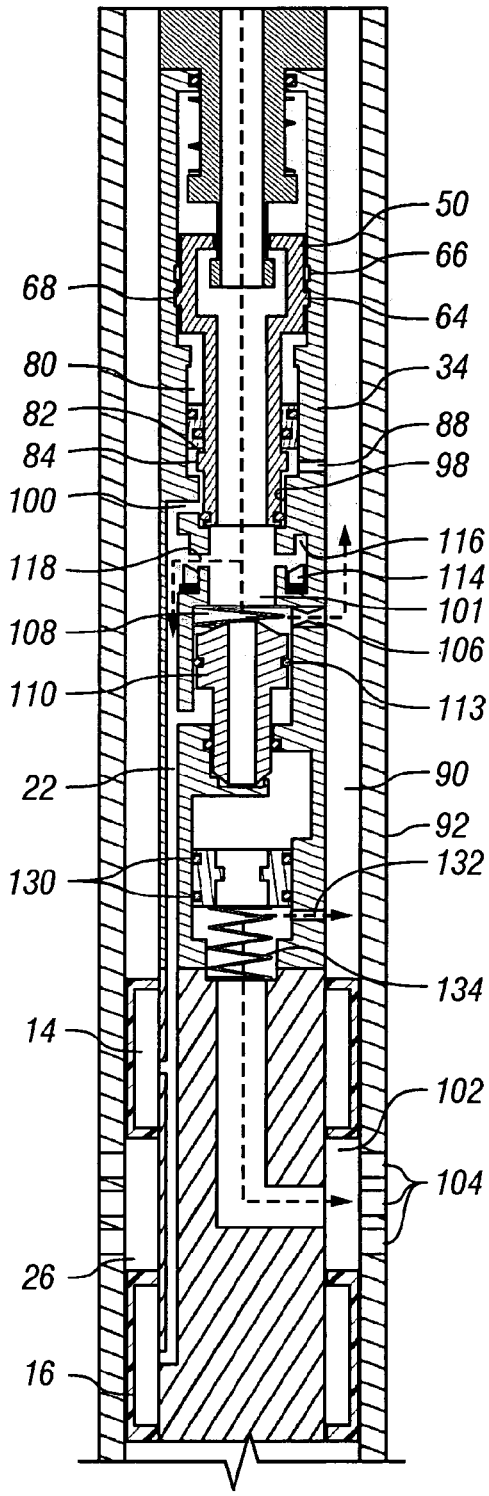
Figure 5A:
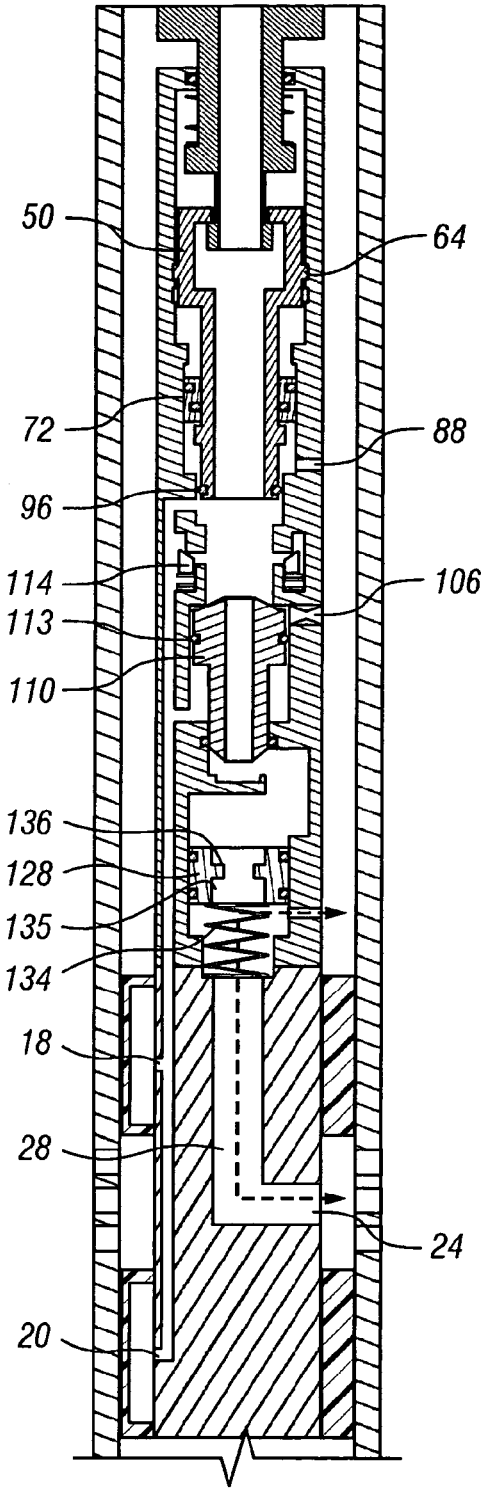
Figure 5B:
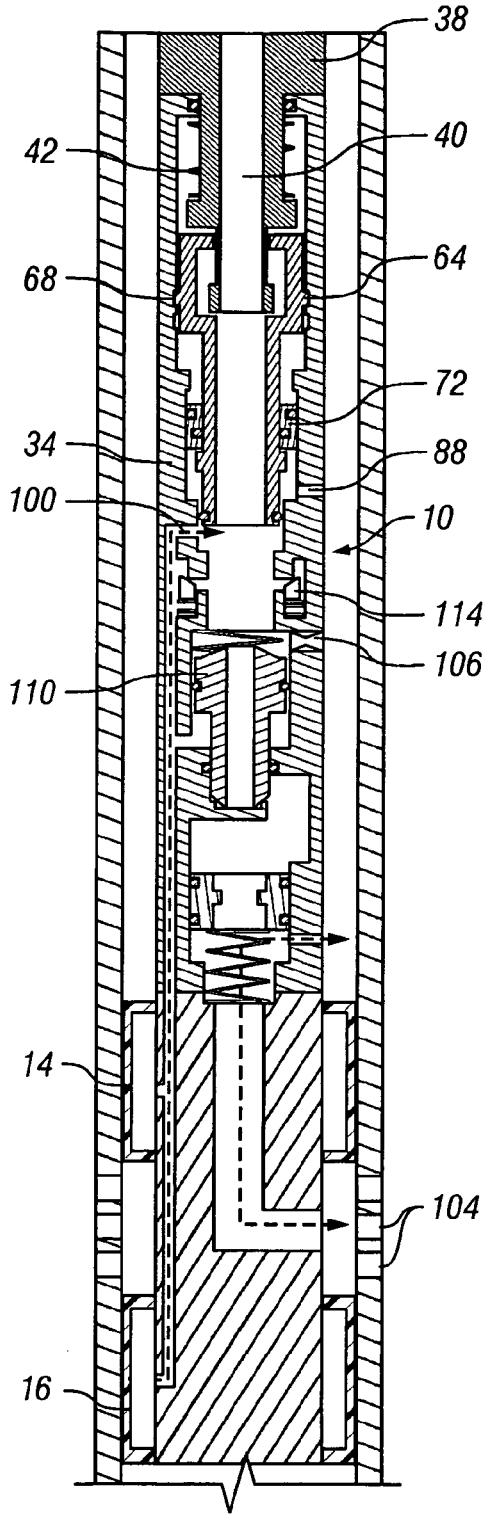

FIG. 5A is a schematic longitudinal sectional view similar to that of FIGS. 3A and 3B and illustrating application of a pulling force to the tool assembly via the tubing string after pressure equalization with formation pressure has occurred and with the packer elements inflated; and FIG. 5B is a schematic longitudinal sectional view similar to that of FIG. 5A and illustrating inflation pressure release of the spaced inflatable packer elements to ready the tool for repositioning or retrieval.

DETAILED DESCRIPTION OF PREFERRED EMBODIMENT

This invention consists of an inflation control system (ICS) that is used as part of an inflatable straddle stimulation tool (inflate tool) for coiled tubing. The ICS does not control the entire operation of the inflate tool, only the process of inflating the elements, storing and releasing the stored pressure, and directing the pumped fluid into the annulus between the packer elements. Additional components are required upstream of the ICS to switch between a "circulate" mode, where fluid exits the tool into the annulus between the tool and casing before reaching the ICS and is returned to surface, and an "inflate/inject" mode, where all flow is forced into the ICS and is used to either inflate the packer elements or stimulate the formation. The ICS is operated with a minimal amount of coiled tubing manipulation and shifts into most of its positions automatically if the appropriate pump schedule is followed.

Figure 1:
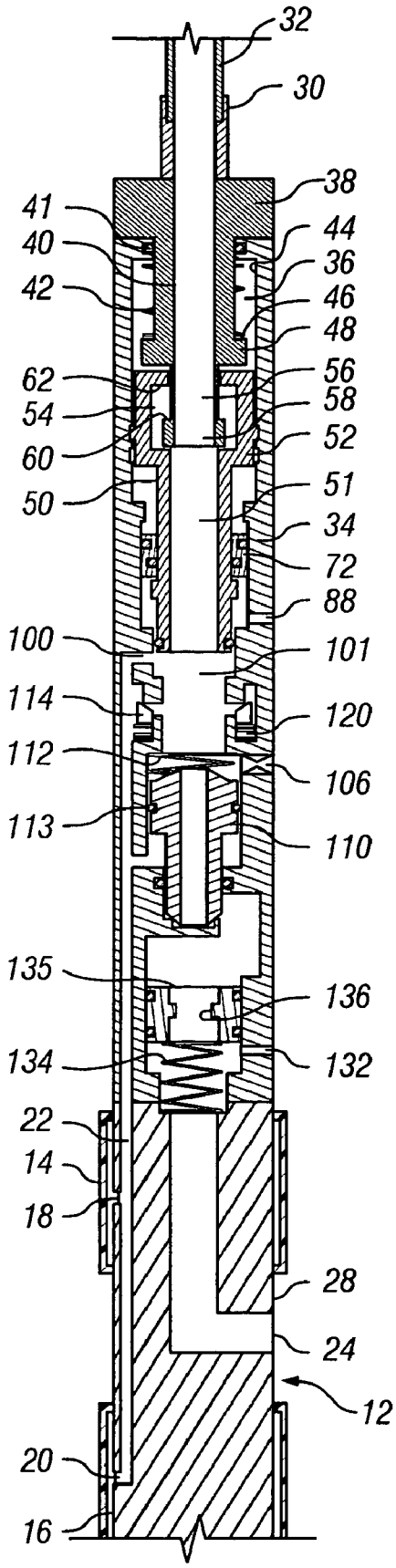

Referring now to the drawings and first to FIG. 1, an inflation control system, shown generally at 10, and embodying the principles of the present invention, is shown in assembly with an inflate straddle well stimulation tool, shown generally at 12. It should be borne in mind that the inflation control system and inflate straddle well stimulation tool assembly is merely intended to be illustrative of the preferred embodiment of the present invention and is not intended to limit the spirit and scope of the invention in any manner whatever. If desired, an integral inflate straddle packer tool may be provided which incorporates an inflation control system of the nature and for the purpose disclosed herein. The inflation control system 10 and the inflate straddle tool 12, whether comprised of connected tool sections or an integral tool assembly, are identified herein simply as the tool. The inflate straddle well stimulation tool 12 is provided with spaced inflatable packer elements 14 and 16, having inflate ports 18 and 20 that are each in communication with an inflation flow passage 22 of the inflation packer tool and the inflation control system. Between the spaced inflatable straddle packer elements 14 and 16 the inflate straddle tool 12 defines an injection port 24 through which treatment fluid is caused to flow into the annulus of a sealed or isolated casing interval 26 that is defined within the casing and between the inflated straddle packer elements 14 and 16 as shown in FIG. 3B. The injection port 24 is in communication with a flow passage 28 that is provided within the straddle packer tool 12 and the inflation control system 10.

At its upper end, the inflation control system 10 is provided with a tubing connector 30 by which a string 32 of tubing, such as coiled tubing or flexible jointed tubing, is connected to the inflation control system 10. The tubing string 32 extends through the wellbore to tubing handling equipment at the surface, by which the tubing string is manipulated for running the tool to a desired location within the well, for repositioning the tool within the well after stimulation or treatment of a zone or interval or for deflating and releasing the inflatable straddle packers to enable movement or retrieval of the straddle stimulation tool. It is envisioned that during a single trip into the well, any desired number of formations or zones may be treated. It is simply appropriate to deflate and de-energize the inflatable packer elements after each stimulation treatment has been completed and to use the coiled tubing to selectively position the tool at another perforated zone or interval of the well casing, where the stimulation treatment process is repeated.

The inflation control system 10 of the straddle stimulation tool defines a tool housing 34 having an internal chamber 36. A deflate shifter member 38 to which the tubing connector 30 and tubing 32 are assembled or to which a tool section is assembled, serves to connect the ICS to the rest of the flow control section of the inflate straddle well stimulation tool 12. The deflate shifter member 38 is connected to the ICS through a very stiff spring 42 which will yield significantly only when a tensile force of predetermined magnitude is applied to the deflate shifter by the tubing string 32. The deflate spring 42 connects the deflate shifter member 38 to the ICS. Therefore, if the ICS is restrained from moving (as when the inflate tool is anchored by the inflated packer elements) and tension is applied to the deflate shifter member 38, the spring 42 will be compressed by the upwardly directed force and the deflate shifter member 38 will move upwardly. If the deflate shifter member 38 moves upwardly and the element pressure piston 50 is in the down position, then the deflate shifter member 38 will engage the element pressure piston 50 and move it to the "up" position. Otherwise, however, the deflate shifter member 38 and element pressure piston 50 will not engage.

The deflate shifter member 38 defines a depending actuating section 40 that extends into the internal chamber 36 and is sealed with respect to the tool housing 34 by an O-ring seal 41. The deflate spring 42 is located within the internal chamber 36 and is positioned with its upper end positioned in force transmitting engagement with a downwardly facing shoulder 44 within the tool housing and its lower end in force transmitting engagement with an upwardly facing shoulder 46 of an annular enlargement or flange 48 of the depending actuating section 40 of the deflate shifter member 38. The deflate spring 42 has a very high spring constant and therefore requires application of a large tensile force to the deflate shifter member 38 in order to compress the deflate spring sufficiently to permit upward travel of the deflate shifter member 38 relative to the tool housing 34.

An element pressure piston 50 is moveable within the internal chamber 36 and defines a stimulation fluid flow passage 51 therethrough. The sole purpose of the element pressure piston 50 is to store and release pressure in the inflatable packer elements. The element pressure piston 50 is comprised in part of a collet 64 that has two positions, an "up" collet position and a "down" collet position. In the up collet position, the packer elements 14 and 16 can be inflated through an inflate equalization port 100, but since the element pressure piston 50 is not sealed within the tool housing at this position, the packer inflation pressure cannot be stored and will always equalize with the coiled tubing pressure. In the down collet position, the inflate equalization port is blocked by the sealed lower end of the element pressure piston 50 and high-pressure fluid will not be allowed to leave the inflated packer elements even after the coiled tubing pressure drops. The element pressure piston 50 is shifted to the "down" collet position by a slider ring 72 and to the "up" collet position by the deflate shifter member 38 and has a lost motion connector housing 52 establishing a connector receptacle 54 within which a connector extension 56 of the depending actuator section 40 of the deflate shifter member 38 is moveable. An enlargement or flange 58 at the lower end of the connector extension 56 defines an upwardly facing shoulder 60 that comes into force transmitting engagement with a downwardly facing internal shoulder 62 when the deflate shifter member 38 is moved upwardly against the force of the deflate spring 42. In absence of this tension force, which is applied via the tubing string 32, the element pressure piston 50 is essentially mechanically isolated from the deflate shifter 38.

The connector housing 52 of the element pressure piston 50 is provided with a collet member 64 that is normally positioned within an upper collet recess 66 of the tool housing as shown in FIGS. 1 and 3A and which is moveable downwardly as shown in FIG. 3B to a position where the collet member 64 is located within a lower collet receptacle 68. The element pressure piston 50 defines an elongate generally cylindrical section 70 about which is positioned a slider ring 72 having external and internal seals 74 and 76 which maintain the slider ring in sealed relation with the elongate generally cylindrical section 70 and an inner surface 78 of the tool housing 34. The sealed slider ring 72 is moveable within an annulus between the generally cylindrical section 70 and the internal surface 78 of the tool housing 34 within limits defined by a downwardly facing internal shoulder 80 of the tool housing 34 and an upwardly facing shoulder 82 of an annular slide ring stop flange 84 of the generally cylindrical section 70 of the element pressure piston 50. The slider ring essentially floats in between the ICS housing and the element pressure piston, with an elastomeric seal between each. Coiled tubing pressure acts on the slider ring 72 from above, and well (annulus) pressure acts on the slider ring from below. The slider ring 72 is essential to the operation of the element pressure piston 50, making it independent of downhole pressure conditions. In other words, if pressure inside the ICS is higher than casing pressure, the resulting force of the slider ring 72 acts downwardly on the element pressure piston 50. If this pressure differential is high enough to overcome the retention force of the collet, the inflatable packer element pressure piston 50 will be shifted to its "down" position; this is how pressure is stored in the inflatable packer elements 14 and 16. If the well pressure is higher than the coiled tubing pressure, however, the slider ring 72 will not exert a force on the inflatable packer element pressure piston 50. This means that, regardless of well conditions, the slider ring 72 cannot unseat the inflatable packer element pressure piston 50 and release the packer element pressure. Thus, the spaced inflatable packer elements 14 and 16 will remain inflated and sealed to the well casing. Downward movement of the packer element pressure piston 50 is limited by an upwardly facing annular shoulder 86 within the tool housing 34. An equalizing passage 88 communicates the annulus 90 between the inflation control system 10 and the well casing 92 with the internal tool chamber 94 that houses the packer element pressure piston 50.

At the lower end of the generally cylindrical section 70 of the packer element pressure piston 50 there is provided an annular sealing member 96 that establishes sealing within a lower cylindrical section 98 of the internal tool chamber 94. An inflate equalization port 100 is in communication with the inflation flow passage 22 and, with the packer element pressure piston 50 in the upward position shown in FIG. 3A, fluid pressure from the tubing string which is communicated through the deflate shifter 38 and the element pressure piston 52 is communicated with the inflation flow passage 22 to the inflation packers 14 and 16, causing inflation thereof for sealing of the well stimulation tool within the well casing 92 at spaced locations defining a casing interval 102 that is typically perforated as shown at 104 for communication with a production formation surrounding the casing interval.

An inflation orifice 106 is provided in the wall structure of the tool housing 34 and communicates the casing annulus 90 with a piston chamber 108 that is defined within the tool housing 34. The inflation orifice 106 makes it possible to inflate the packer elements to a desired pressure differential without actually knowing the well pressure at the tool. This is because a given flow rate across the inflation orifice 106 results in a known pressure drop. This pressure drop is effectively independent of the absolute values of pressure on each side of the orifice. Furthermore, by changing orifice properties, the operator can achieve different pressure drops with the same flow rate; this may be necessary depending on the capabilities of the pump used.

An inflate/inject piston 110 is moveable within the piston chamber 108 and is urged downwardly by a compression spring member 112, referred to as an inject spring, and is sealed within the piston chamber 108 by a piston seal member 113. The inflate/inject piston 110 directs pumped fluid either across the inflate orifice 106 and out of the ICS, or it blocks this path and directs the fluid down the ICS and ultimately in between the inflated packer elements and into the formation. If the element pressure piston is in the up position, then the inflate/inject piston 110 is pressure-balanced and is forced down by the inject spring 112. Once the element pressure piston 50 shifts to the down position as shown in FIG. 1 and the packer elements become inflated, the inflate/inject piston 110 will have element pressure acting from below and coiled tubing pressure acting from above. When the coiled tubing pressure drops below element pressure, the inflate/inject piston 110 will then move up, compressing the inject spring 112 and sealing against the ICS body. The inflate/inject piston 110 is provided with a piston extension or stem 107 that extends into a piston receptacle 109 and is sealed to the tool housing by an O-ring seal 111. With the inflate/inject piston 110 in the position shown in FIGS. 3A and 3B, fluid pressure being injected through the inflation control system tool from the tubing string, in addition to acting within the inflatable packer elements, will also be vented through the inflation orifice 106 to the casing annulus.

An inflation poppet valve 114 is located within a valve chamber 116 and is urged to a position closing a valve passage 118 by a valve spring 120. The inflation poppet is essentially a check valve that will allow fluid to flow from inside the coiled tubing, into the internal chamber 101 and to the inflation port, but not from the spaced inflatable packers through the passage 22 and to the internal chamber 101. This feature causes the spaced inflatable packer elements to remain inflated and sealing the straddle stimulation tool to the casing, until packer element pressure is subsequently equalized with tubing pressure. During inflation, fluid flows into the inflatable packer elements through the inflate equalization port until the element pressure piston 50 shifts to the down position of FIG. 3B. After the inflatable packer element pressure piston shifts downwardly, packer inflation continues across the inflation poppet. When the element pressure piston 50 has moved downwardly, as shown in FIG. 3B, to a position closing the inflate equalization port 100 packer inflation pressure flows past the poppet valve into the inflation flow passage 22 to the inflatable packer elements 14 and 16. Since the inflation poppet valve 114 is a unidirectional valve, i.e., a check valve, the inflation pressure of the inflatable packer elements will be trapped and the packer elements will remain inflated, even when the inflation pressure upstream of the poppet valve has diminished. Thus, with the inflatable packer elements inflated and sealing the tool within the casing, tubing pressure can be relaxed and the packer elements will remain inflated so that well stimulation activities can be carried out in the casing annulus interval between the spaced packer elements. When the element pressure piston 50 is at its upper position, as shown in FIG. 3A the inflatable packer elements can be inflated at a low flow rate since the flow path from the tubing string to the inflation flow passage 22 is open via the inflation equalization port 100. When the element pressure piston 50 is at its lower position, as shown in FIG. 3B the inflatable packer elements are inflated at a high flow rate since packer inflation pressure is blocked from the inflation equalization port and must unseat the poppet valve 114 to flow into the inflation flow passage 22 and the inflatable packer elements 14 and 16.

The piston chamber below the inflate/inject piston 110 is in communication with the inflation flow passage 22 via a port 122 so that, under low fluid flow conditions packer inflation as shown in FIG. 3A, injection pressure from the tubing acts on the greater upper surface area of the inflate/inject piston 110 and acts via the port 122 on the lesser lower surface area of the inflate/inject piston 110, thus causing the inflate/inject piston 110 to be urged downwardly by pressure responsive force as well as by the force of its compression spring member 112. Thus, the inflate/inject piston 110, when the spaced inflatable packer elements are being inflated at a low flow rate, as shown in FIG. 3A and at a high flow rate, as shown in FIG. 3B, will be positioned at its maximum downward extent and the restricted orifice 106 will be open for control of inflation pressure within the internal chamber 101.

Figure 4A:
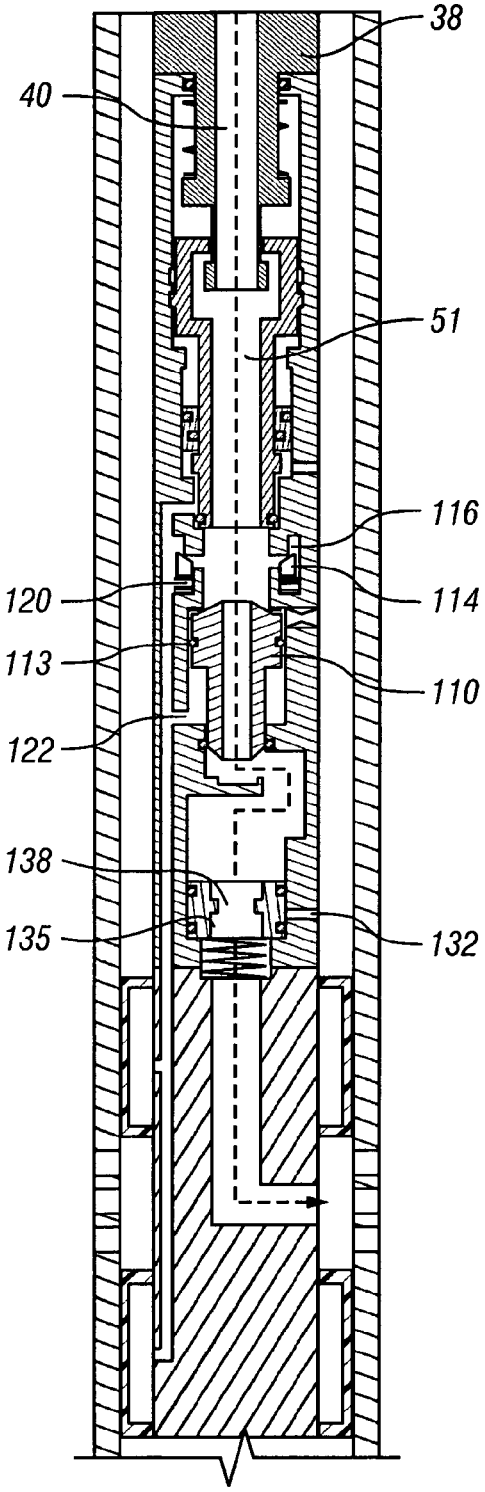

The tool housing 34 defines an equalizing piston chamber 124 having a cylindrical wall surface 126. An equalizing piston member 128 is moveable with the equalizing piston chamber 124 and is sealed with respect to the cylindrical wall surface 126 by annular piston seals 130. An equalizing passage 132 is defined by the tool housing 34 and communicates the casing annulus 92 with the equalizing piston chamber 124 below the equalizing piston when the equalizing piston is at its upper position. A piston spring 134 is located within the tool housing 34 below the equalizing piston and imparts upwardly directed spring force to the equalizing piston and normally maintains the position of the equalization piston above the communication port 132 as is evident from FIGS. 1, 3A, 3B, 4B, 5A and 5B. The equalization piston member 128 defines an internal flow passage 135 and has an internal flow restrictor 136 located therein, which defines a restricted orifice 138. During injection of well stimulation fluid, typically at high pressure, the fluid flow through the restricted orifice 138 develops a resultant force on the equalizing piston forcing the equalizing piston downwardly against the compression of its piston spring 134. This flow responsive downward movement of the equalizing piston compresses the piston spring 134 and causes the equalizing piston member to block the communication port 132 as shown in FIG. 4A. The equalization piston member 128 ensures that, unless fluid is being pumped through the ICS and into the formation, the pressure will equalize within the annulus above and below the upper inflatable packer element 14. This is important both during inflation and deflation, when a pressure imbalance can damage the inflatable packer elements and possibly pose a safety hazard. If no fluid is flowing across the equalization piston member 128, the equalization piston member will be is forced up by its piston spring 134, opening the communication or communication port 132 from the inside of the tool to the casing annulus 90. Once fluid flows across the orifice 138 in the equalization piston member, however, the resulting pressure drop will force the piston down, closing off the communication port 132 and forcing all fluid to travel down the tool, through the fluid flow passage 28 and into the formation via the casing perforations 104.

Operation of the Inflation Control System

Figure 2:
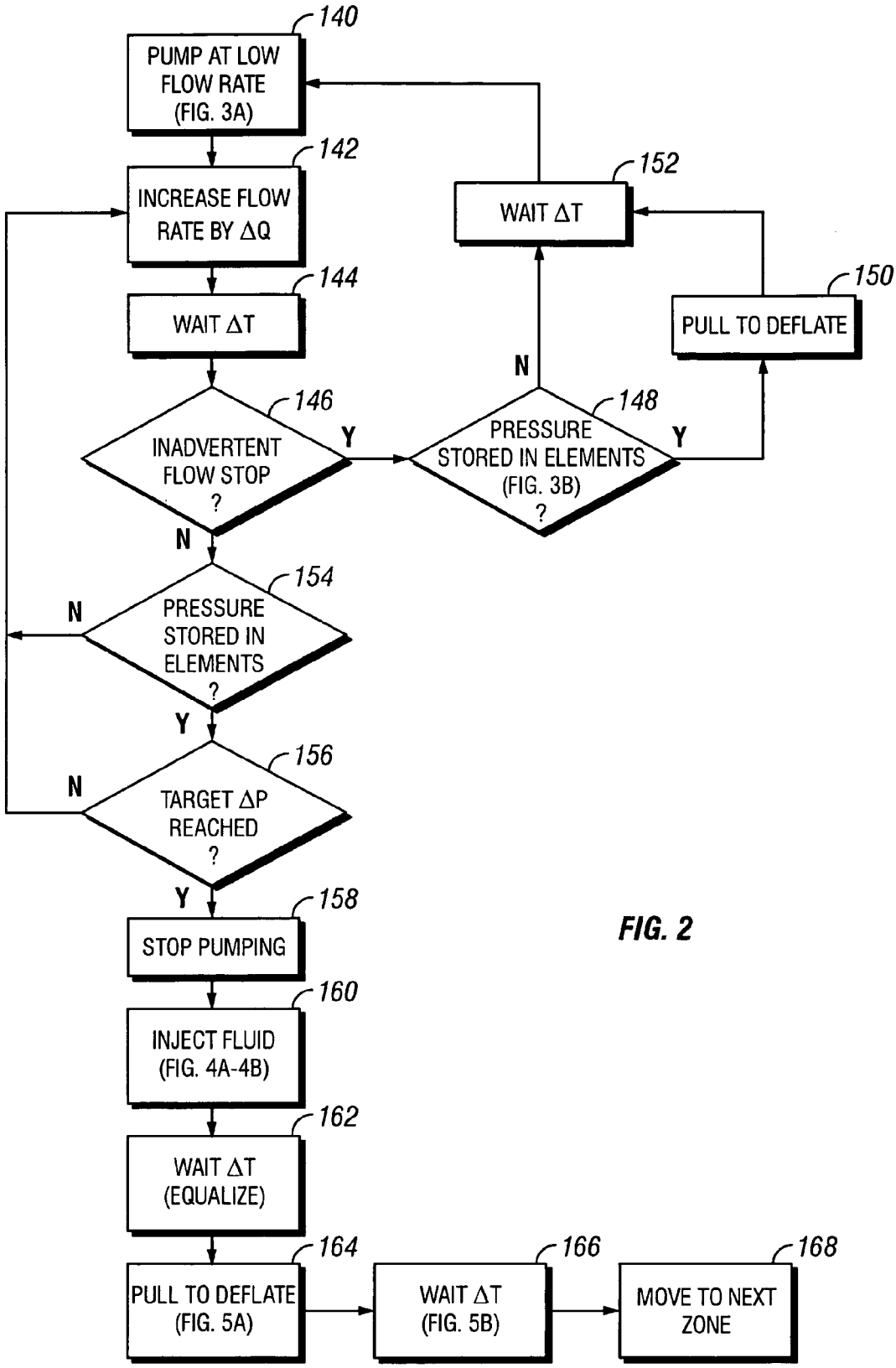

As mentioned above, the ICS must be used in conjunction with components that, when assembled upstream of the ICS, direct pumped fluid either 1) out of the tool before reaching the ICS or 2) through the ICS. It is important to keep the ICS isolated from flow until the operator is ready to inflate the packer elements. Alternatively, the pressure differential stored in the packer elements by the ICS is directly related to the flow rate. Therefore, it is equally important that, when the ICS is operated, all of the pumped fluid is directed through the ICS before exiting the tool. The following description of the operation of the ICS assumes that all pumped fluid is being directed through the ICS and that the operator has located the proper depth for straddling the casing perforations and is ready to begin packer element inflation. The operation of the ICS will be broken down into three major categories, each of which is described below. Also, as explained above, FIG. 2 is a block diagram schematic illustration of the major steps in the operation of the ICS and thus depicts the various stages and features of the surface controlled packer element inflation, fluid injection and packer element deflation that enables the straddle stimulation tool to be used for treatment of a number of different subsurface zones without necessitating retrieval of the tool from the well after each casing interval treatment.

1. Inflate

Once the tool is located at the proper depth in the well and the spaced inflatable packer elements are straddling the zone of interest, the operator begins inflating the spaced inflatable packer elements. Inflation fluid is pumped through the ICS at a low flow rate as indicated by schematic block 140 of FIG. 2. This process is also depicted in FIGS. 3A and 3B, where the flow arrows show the path of the pumped fluid. The only way the inflation fluid can exit the ICS is through the inflation orifice 106. Inflation fluid is pumped slowly at first, since the inflatable packer elements 14 and 16 can be damaged if inflated too rapidly. Notice that the inflation fluid can flow simultaneously through the inflate equalization port 100 to the inflation flow passage 22 and the inflatable packer elements and through the inflation orifice 106 to the annulus 90. This means that the same pressure drop across the inflation orifice 106 due to the pump rate is seen across both inflatable packer elements. Therefore, the packer elements will begin to inflate, even at a relatively low flow rate; this is why it is important to keep the ICS isolated from flow until it is time to inflate the packer elements.

After the inflatable packer elements have had adequate time to adjust to the pressure differential (this time varies with the magnitude of the differential) the flow rate is increased by some fixed amount, $\Delta Q$, which results in a corresponding packer element pressure differential increase. Again, the operator must wait for the inflatable packer elements to adjust to the change in pressure before proceeding.

It is important to realize that, if the pump stops for any reason before inflation is completed, the inflate/inject piston will unseat and move up some amount. This property makes it impossible to simply start pumping to continue inflating, since some of the pumped fluid will not be directed across the inflate orifice but will instead travel down the inject path below the inflate/inject piston. However, the ICS is robust to situations where the pumping stops inadvertently for any reason. The slider ring will not shift the element pressure piston until a minimum pressure differential has been achieved (See FIG. 3B). When stored in the inflatable packer elements, this minimum pressure differential provides enough anchoring so that the operator can pull at surface and deflate the elements. If, on the other hand, the pump stops before the minimum pressure is reached and the element pressure piston has not shifted, the operator simply waits for whatever pressure is stored in the elements to equalize through the inflate equalization port. After the pressure has equalized in either situation, the inflate/inject piston will shift down to its inflate position, and the operator can then repeat the inflation process.

The operator continues the process of increasing the pump rate incrementally and allowing the elements to respond until the target pressure differential is reached. Note that the target pressure differential must always be larger than the minimum pressure stored by the element pressure piston; otherwise the elements will simply deflate after pumping stops. Once the desired pressure differential is achieved, the operator stops pumping. As soon as pumping stops, the pressure differential across the inflate/inject piston causes it to move upward, closing off the exit path across the inflate orifice and opening the path through the rest of the ICS. From this point on, all fluid pumped through the ICS will flow through the bottom of the inflate/inject piston and out the inject port.

2. Inject

Once the elements are inflated to the desired pressure differential, the stimulation fluid is pumped from surface, through the ICS, and into the formation. In order for the stimulation fluid (often acid) to reach the tool, the operator must first displace whatever fluid is in the coil. The operator will do this by pumping the stimulation fluid to force the undesired fluid out of the tool above the ICS and up to surface. Once the stimulation fluid reaches the tool, the operator stops circulating to surface, closes off the circulate path, and opens the inject path that directs the fluid through the ICS.

Because the inflate/inject piston is in the up position, the stimulation fluid cannot exit the ICS across the inflate orifice and will instead travel through the lower portion of the ICS. At some low flow rate (approximately 0.25 bpm to 0.5 bpm), the stimulation fluid generates a pressure drop across the equalize piston that is sufficient to close the piston and shut off the inject equalization port (See FIG. 4A). As long as the stimulation fluid is pumped at or above this minimum flow rate, the only exit path for the stimulation fluid is out the inject port and into the formation.

As an alternative to the orifice in the equalize piston, a unidirectional valve such as a check valve may be used instead. The check valve allows flow from surface to pass through after a nominal pressure differential has been achieved, but the valve does not allow fluid to pass through from below. The shifting pressure differential of the check valve for pumped fluid is sized such that the equalize piston shifts down to block the inject equalization port before the check valve opens. For example, if it requires 50 psi of pressure differential to shift the equalize piston, the check valve might be designed to open with 100 psi of differential. This characteristic ensures that all the pumped fluid will travel out the inject port and not the inject equalization port.

Figure 4B:
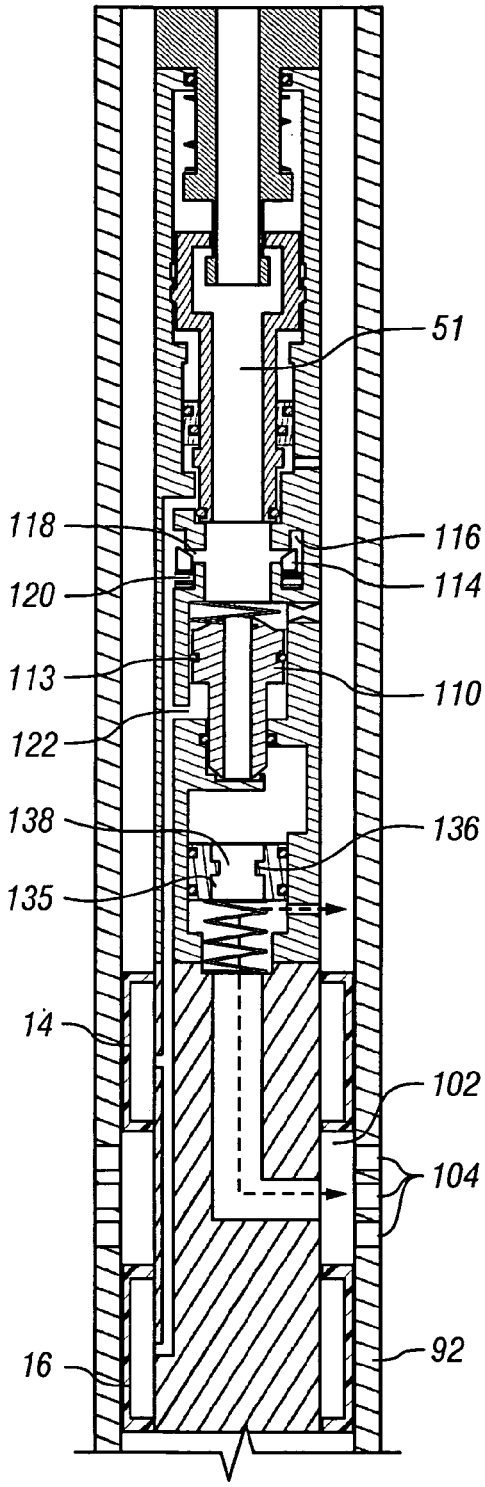

When pumping stops, the equalization piston returns to its original position and open the inject equalization port (See FIG. 4B). This allows flow through the inject equalization port in either direction to balance the pressure above and below the upper packer element. This is an important feature of the ICS, especially during inflation and deflation when a pressure differential around the upper packer element can damage the packer elements and generate enormous forces that can pose a safety hazard.

This invention relates to the flow control portion of a straddle tool and not the tool in its entirety. Consequently, for clarity in FIG. 1 and FIGS. 3–5, not all of the porting in a typical straddle tool is depicted. For example, a bypass port is usually present that allows at all times communication from below the lower packer element to above the upper packer element. Therefore, when the inject equalization port balances pressure across the upper packer element, the pressure also becomes balanced across the lower packer element.

3. Deflate

The process of circulating fluid to the tool and then injecting it into the formation can continue indefinitely without deflating the packer elements. When the operator has finished treating a particular zone and wishes to deflate the packer elements, the operator must simply wait a sufficient period of time for the pressure across the packer elements to equalize through the inject equalization port 132. The amount of time required for this will vary depending on the characteristics of each zone.

Once the pressure across the packer elements is equalized with casing pressure, the operator will apply tension to the tool through the coiled tubing to achieve packer deflation. Since the deflate shifter member 38 is only connected to the ICS through the deflate spring 42 and the packer elements are anchored to casing by inflation pressure, the deflate spring will compress when tension is applied. When the deflate spring 42 is compressed by the tension force of the tubing, the deflate shifter member 38 engages the element pressure piston 50, moving it to the up position (See FIG. 5A). The high-pressure fluid that is stored in the inflatable packer elements 14 and 16 will now be released through the inflate equalization port 100 and into the internal flow passage of the ICS.

Once enough time has elapsed for the elements to become equalized, the inflate/inject piston member 110 will become pressure balanced and will be returned to its down (starting) position by the force of the spring 112. At this point, the ICS is completely reset and may be moved to another zone. The above process is repeated as needed for each zone in the well.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for controlling inflation and deflation of spaced inflatable packer elements of a tubing conveyed straddle stimulation tool within a well casing of a well, the straddle stimulation tool having a packer pressure control member therein being moveable responsive to tubing pressure and casing pressure and being moveable by predetermined tubing applied tension force, said method comprising:

developing packer element inflation pressure within said straddle stimulation tool with tubing pressure and inflating the spaced inflatable packer elements for sealing thereof within the well casing and defining an isolated casing interval;

causing tubing pressure responsive positioning of said packer pressure control member for maintaining inflation of the spaced inflatable packer elements;

injecting well stimulation fluid through said straddle stimulation tool and into the isolated casing interval;

after completion of well stimulation, applying sufficient tension force to said straddle stimulation tool via the tubing for moving said packer pressure control member by tubing applied tension force and releasing inflation pressure from the spaced inflatable packer elements and freeing said straddle stimulation tool for tubing conveyance within the well casing;

disposing a spring member in force transmitting relation between a deflate shifter member and said straddle stimulation tool to urge said deflate shifter member in a direction opposing said pulling force, said tubing being able to apply a pulling force to said packer element pressure control member only after having overcome the force of said spring member; and applying sufficient pulling force to said inflate shifter member via the tubing string to overcome the force of said spring member and move said packer element pressure control member to said packer element deflate position.

2. A straddle stimulation tool for isolating and stimulating selected formations in wells, comprising:

a tool body having spaced inflatable packer elements and defining a fluid injection passage having a fluid injection port located between said spaced inflatable packer elements, said tool body also defining an inflation flow passage in fluid communication with said spaced inflatable packer elements and defining an inflation control chamber and an inflation equalization port in communication with said inflation flow passage and said inflation control chamber;

a packer element pressure control member defining a stimulation fluid flow passage and being moveable within a pressure control section between a pressure equalizing position at which said equalizing port is open and a pressure storing position at which said packer element pressure control member blocks fluid flow through said equalizing port;

a unidirectional valve member being located within said tool body and permitting unidirectional flow of stimulation fluid from said inflation control chamber to said inflation flow passage when said packer element pressure control member is located at said pressure storing position; and a deflate shifter member being moveable relative to said tool body and having a tubing connector to which a fluid supplying and conveyance tubing string is connected, said deflate shifter member causing movement of said packer element pressure control member to said pressure equalizing position upon application of a tension force of predetermined magnitude to said deflate shifter by the fluid supplying and conveyance tubing string;

said packer element pressure control member being moveable from said pressure equalizing position to said pressure storing position responsive to the pressure of inflation fluid.

3. The straddle stimulation tool of claim 2, comprising:

said tool body defining an internal chamber to which tubing pressure is communicated;

an inflation control orifice being mounted to said tool body and establishing communication of said internal chamber with an annulus between the tool body and a well casing;

an inflate/inject piston being moveable within said internal chamber and having an injection passage therethrough, said inflate/inject piston having a first position permitting flow of fluid through said inflation control orifice and a second position blocking the flow of fluid through said inflation control orifice; and a spring member maintaining said inflate/inject piston at said first position.

4. The straddle stimulation tool of claim 2, comprising:

said packer element pressure control member defining a connection receptacle and a downwardly facing internal shoulder;

said deflate shifter member defining a flow passage in communication with the tubing string and having a connector extension being moveable within said connector receptacle, said connector extension defining an upwardly facing pulling shoulder establishing force transmitting engagement with said downwardly facing internal shoulder upon predetermined upward movement of said deflate shifter member by the tubing string and upon further upward movement said deflate shifter moving said packer element pressure control member to said pressure equalizing position.

5. The straddle stimulation tool of claim 4, comprising:

a deflate spring being located within said inflation control section and establishing a preload force urging said deflate shifter member downwardly;

said deflate shifter moving said packer element pressure control member upwardly from said pressure storing position to said pressure equalizing position only after overcoming the preload force of said deflate spring; and after tubing pressure has been decreased for packer element deflation and packer element pressure has equalized with the decreased tubing pressure manipulation of the tubing string at the surface causing conveyance movement of said straddle stimulation tool upwardly or downwardly within the well.

6. The straddle stimulation tool of claim 2, comprising:

said tool body defining an equalizing piston chamber and defining an inject equalization port communicating said equalizing piston chamber with the well casing;

an equalizing piston member being moveable within said equalizing piston chamber responsive to pressure differential force and having a normal position equalizing injection pressure with casing pressure, said equalizing piston member having an injection position blocking said inject equalization port responsive to predetermined injection flow rate.

7. The straddle stimulation tool of claim 6, comprising:

a spring member maintaining an urging force on said equalizing piston member and urging said equalizing piston member to said normal position thereof.

8. A straddle stimulation tool for isolating and stimulating selected formations in wells, comprising:

a tool body having spaced inflatable packer elements and defining a fluid injection passage having a fluid injection port located between said spaced inflatable packer elements, said tool body also defining an inflation flow passage in fluid communication with said spaced inflatable packer elements and defining an inflation control chamber and an inflation equalization port in communication with said inflation flow passage and said inflation control chamber;

a packer element pressure control member defining a stimulation fluid flow passage and being moveable within a pressure control section between a pressure equalizing position at which said equalizing port is open and a pressure storing position at which said packer element pressure control member blocks fluid flow through said equalizing port;

a unidirectional valve member being located within said tool body and permitting unidirectional flow of stimulation fluid from said inflation control chamber to said inflation flow passage when said packer element pressure control member is located at said pressure storing position;

a deflate shifter member being moveable relative to said tool body and having a tubing connector to which a fluid supplying and conveyance tubing string is connected, said deflate shifter member causing movement of said packer element pressure control member to said pressure equalizing position upon application of a tension force of predetermined magnitude to said deflate shifter by the fluid supplying and conveyance tubing string;

a force transmitting shoulder being defined by said packer element pressure control member; and a piston ring being interposed between and in sealed relation with said packer element pressure control member and said tool body and engaging said force transmitting shoulder responsive to fluid pressure acting on said piston ring, said piston ring moving said pressure control member from said pressure equalizing position to said pressure storing position responsive to injection fluid pressure acting on said piston ring.

9. The straddle stimulation tool of claim 8, comprising:

a collet retaining said packer element pressure control member at said pressure equalizing position and said pressure storing position and releasing said packer element pressure control member for movement from said pressure equalizing position to said pressure storing position upon application of predetermined fluid flow responsive downward force of said piston ring, said collet releasing said packer element pressure control member for mechanically energized movement from said pressure storing position to said pressure equalizing position upon application of predetermined upward force thereto.

* * * * *